US009023187B2

(12) United States Patent
Parker et al.

(10) Patent No.: US 9,023,187 B2
(45) Date of Patent: May 5, 2015

(54) TURBO TITANIUM COATING TECHNOLOGY FOR BROAD APPLICATION

(75) Inventors: Margaret E Parker, San Diego, CA (US); Piotr Cieplak, San Diego, CA (US); Barbara Gorecka, San Diego, CA (US)

(73) Assignee: Crista Chemical Company LLC, Santee, CA (US)

( * ) Notice: Subject to any disclaimer, the term of this patent is extended or adjusted under 35 U.S.C. 154(b) by 691 days.

(21) Appl. No.: 13/366,159

(22) Filed: Feb. 3, 2012

(65) Prior Publication Data

US 2012/0199488 A1 Aug. 9, 2012

Related U.S. Application Data

(60) Provisional application No. 61/439,758, filed on Feb. 4, 2011.

(51) Int. Cl.

| | |
|---|---|
| ***C25D 5/54*** | (2006.01) |
| ***C25D 5/18*** | (2006.01) |
| ***C23C 18/16*** | (2006.01) |
| ***C23C 18/20*** | (2006.01) |
| ***C23C 18/24*** | (2006.01) |
| ***C23C 18/30*** | (2006.01) |
| ***C23C 18/32*** | (2006.01) |
| *C25D 3/50* | (2006.01) |

(52) U.S. Cl.

CPC ..... *C25D 5/18* (2013.01); *C23C 18/1644* (2013.01); *C23C 18/1653* (2013.01); *C23C 18/2086* (2013.01); *C23C 18/24* (2013.01); *C23C 18/30* (2013.01); *C23C 18/32* (2013.01); *C25D 3/50* (2013.01)

(58) Field of Classification Search

USPC ..... 205/158, 167, 170, 189

See application file for complete search history.

(56) References Cited

U.S. PATENT DOCUMENTS

| | | | | | |
|---|---|---|---|---|---|
| 3,666,637 | A | * | 5/1972 | MacKay | 205/159 |
| 3,849,172 | A | * | 11/1974 | Chin et al. | 428/462 |
| 3,968,270 | A | * | 7/1976 | Hasegawa | 427/472 |
| 4,600,609 | A | * | 7/1986 | Leever et al. | 427/438 |

OTHER PUBLICATIONS

Robin et al, Journal of Applied Electrochemistry, 2000, 30, 239-246.*

* cited by examiner

*Primary Examiner* — Luan Van
*Assistant Examiner* — Radha Narayanan

(57) ABSTRACT

A method for electroplating titanium alloy coating into plastic and carbon foam comprises the steps of activating the given specimen, deposition of electroless nickel and electroplating process of titanium alloy to the surface of the specimen. The electroplating process of electroplating titanium alloy coating includes a direct current method and a pulse plating method. The direct current method characterized by lager sized grains and the pulse plating method characterized by smaller sized grains. The advantages of proposed electroplating processes are: a) low cost, b) very broad applications and c) relatively low number of the process steps. Unique combination of physical, mechanical and chemical properties makes the electroplating methods of titanium coating an attractive technology for medicine, biotechnology, sports, defense, aeronautic, and auto industries.

16 Claims, 31 Drawing Sheets
(25 of 31 Drawing Sheet(s) Filed in Color)

| Sample | Max Flexural Strength (lbs) | Max Flexural Stress (psi) | Modulus of Elasticity (Bend) (psi) | Support Span (in) | Depth (in) | Width (in) |
|---|---|---|---|---|---|---|
| 01 | 260 | 25,228 | 370,685 | 1.200 | 0.1590 | 0.7830 |
| 02 | 253 | 24,530 | 397,380 | 1.200 | 0.1590 | 0.7840 |
| 03 | 252 | 24,786 | 374,918 | 1.200 | 0.1580 | 0.7825 |
| 04 | 259 | 24,813 | 409,061 | 1.200 | 0.1600 | 0.7830 |
| Foam Block | 128 | 2,256 | 143,883 | 1.280 | 0.2620 | 1.4860 |

FIG. 12

| Element | Plastic (Weight %) | |
|---|---|---|
| | Core | Coat |
| C | 73.5 | 30.88 |
| O | 14.88 | 5.08 |
| Ti | <0.01 | 1.92 |
| Ni | 11.62 | 62.12 |

FIG. 13

| Element | Foam (Weight %) | |
|---|---|---|
| | Core | Coat |
| C | 74.94 | 4.77 |
| O | 5.23 | <0.01 |
| Na | 1.72 | 0.77 |
| P | 0.85 | 7.87 |
| S | 0.16 | <0.01 |
| Cl | 0.16 | <0.01 |
| K | 0.08 | <0.01 |
| Ni | 16.89 | 86.59 |

FIG. 14

TURBO TITANIUM COATING TECHNOLOGY FOR BROAD APPLICATION

The current application claims a priority to the U.S. Provisional Patent application Ser. No. 61/439,758 filed on Feb. 4, 2011.

FIELD OF THE INVENTION

The present invention relates generally to electroplating titanium and titanium alloy on variety of substrates from sulfuric acid solution. The substrates are defined as any form of plastic or carbon.

BACKGROUND OF THE INVENTION

The article of interest to be used in an automotive, medical, defense and industrial applications should have the following properties; it must be strong, wear resistant, light weighted and display high resilience, stiffness at room temperature as well as at elevated temperature up to 200° C., while having been manufactured by a convenient and cost-effective method. One way of achieving this goal is to employ titanium coated modern plastic, composite materials and carbon foam materials. Titanium is a metal characterized by low density (4.5 g/cm$^3$), high tensile strength, fatigue, high crack, and corrosion resistance. It is even resistant to long time exposure to seawater, aqua regia and chlorine. Titanium was discovered in the last decade of the XVIII century and its most common compound, titanium dioxide, has found immediate applications in manufacturing of white pigments (titanium white). Besides that the main applications of titanium and its alloys are: in aerospace and marine industries for production of aircraft, armor plating, naval ships, spacecrafts, missiles, corrosion resistant pipes, high-end products in auto-industry, sport equipment (tennis rackets, golf clubs, bicycles) and medical equipments and products (orthopedic equipment, implants, joint replacements, surgical equipment). Titanium is non-toxic and does not cause allergies. Since production of the metallic form of titanium is a complex and expensive process we propose in this invention to design a process for coating various materials, including plastic, composite materials and carbon foam with titanium or titanium alloys using electroplating technique. The main idea behind that invention is to design a new kinds of materials, that will: a) have lower cost compared to metallic titanium, b) maintain the tensile strength, corrosion resistance and other properties of titanium metal, c) be lightweight. This is achieved by combining already low-density plastics, or carbon foam with electrodeposited light titanium metal or titanium alloys. The densities of most popular plastics are in the range from 0.9 to 2.2 g/cm$^3$. The current coating technologies consist of the metal on metal deposition which is not available commercially but was tested experimentally and expensive solid titanium deposition from metal vapor. One notable example of the application of these new materials can be in the form of the stiffening tubes coated with titanium-zirconium over plastic for the wheel chair use. Our new revolutionary material-Turbo titanium with low weight, high yield strength and cost effective method of manufacturing has much broader application than conventional solid titanium.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 12 is a table showing the mechanical properties and the dimensions of the of the test samples which are explained through FIG. 7 to FIG. 11.

FIG. 13 is a table showing the weighted percentage of the elements in the test sample 01 through 04.

FIG. 14 is a table showing the weighted percentage of the elements in the test sample 05.

DETAIL DESCRIPTIONS OF THE INVENTION

Figure 2:
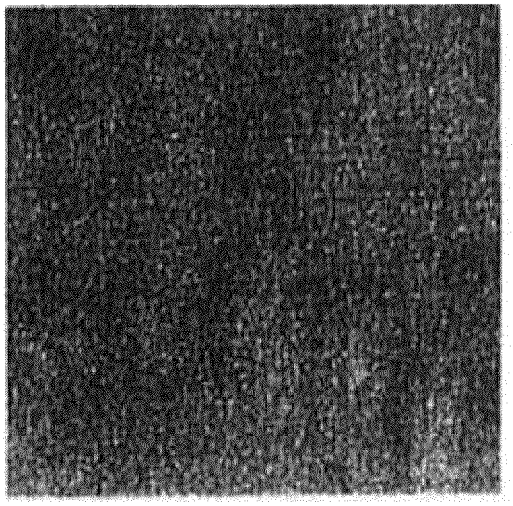
FIG. 2 is a demonstration of the grain size in the pulse current method in the present invention.
Figure 1:
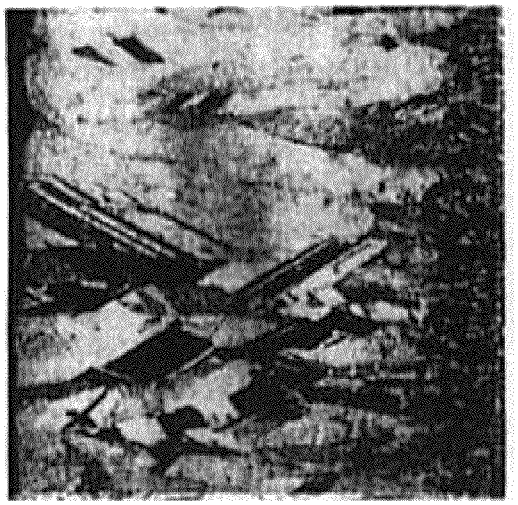
FIG. 1 is a demonstration of the grain size in the direct current method in the present invention.
Figure 3:
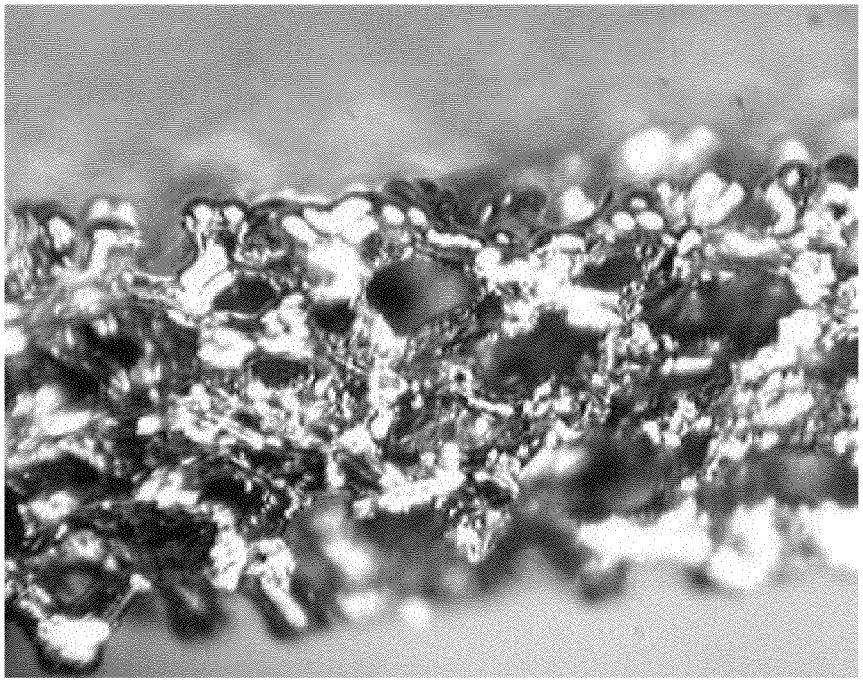
FIG. 3 is an example of the electroless nickel plating of the carbon foam.
Figure 4:
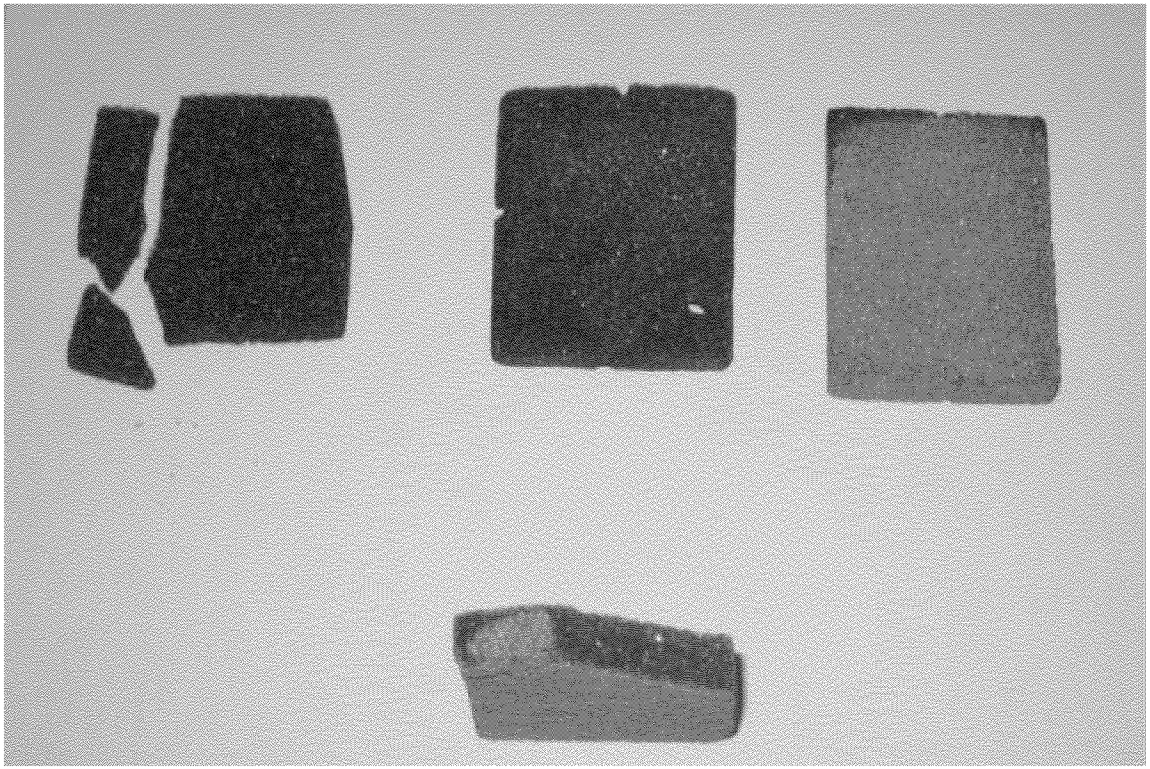
FIG. 4 is an example of electroless nickel and titanium alloy plating of the carbon form.
Figure 5:
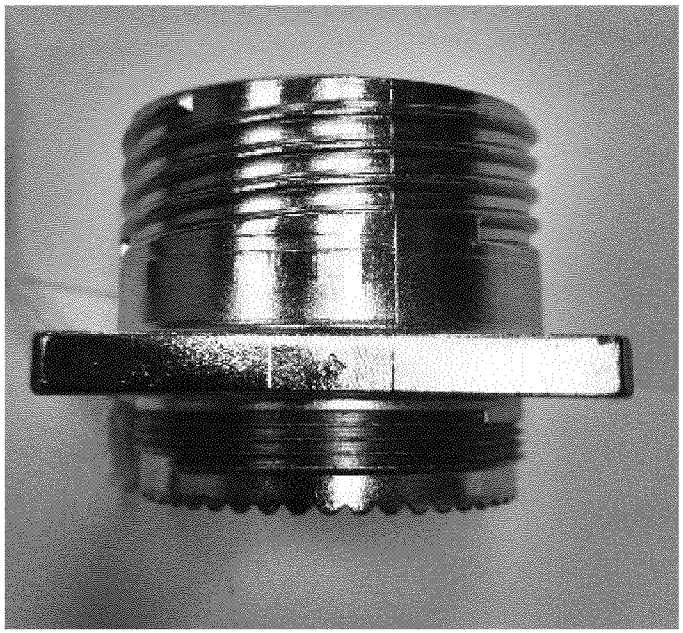
FIG. 5 is an example of electroless nickel and titanium alloy plating of the Ultem (plastic).
Figure 6:
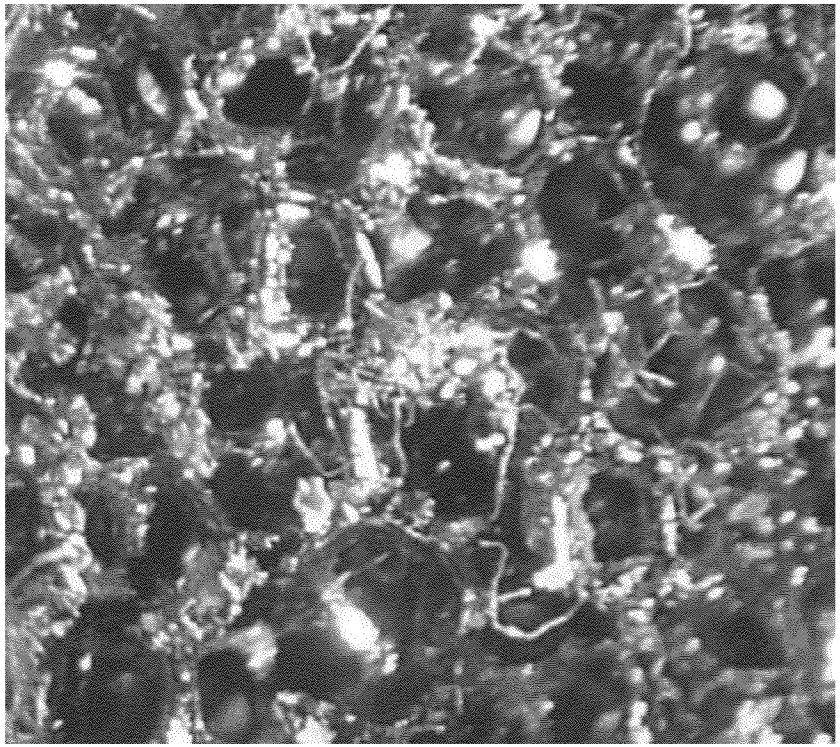
FIG. 6 is titanium zirconium plated carbon foam under the microscope and the magnification being 60×.

All illustrations of the drawings are for the purpose of describing selected versions of the present invention and are not intended to limit the scope of the present invention.

An electrochemical process, in which a titanium metal layer is electroplated on a variety of substrates, obtains a coating of titanium alloys. It is known that electroplating of titanium from aqueous solution is very difficult to achieve because of the aqueous solution's large negative redox potential. Standard electrode potentials of titanium and zirconium (as an example of the other metal in alloy) are much more negative than that of hydrogen; therefore, the hydrogen would get reduced before the titanium or zirconium. Replacing water with sulfuric acid solution and maintaining its pH at the value of 5 using appropriate buffer alleviates the problem of reducing the titanium and zirconium before the hydrogen, which takes place in the aqueous solution. Such change of conditions causes shifting of the reduction potential of the titanium ions toward more positive values. This effect has been demonstrated by the polarization curves of the Ti—Zr potentiodynamically measured in the sulfuric acid solution. The present invention applies an isotropic or quasi-isotropic metallic coating or layer by electroplating which minimizes the formation of columnar and elongated grains and any undesirable crystallographic texture. According to the present invention, a method of treating a titanium alloy coating to a surface of a substrate (plastic, carbon foam and others) comprises three main steps.

1. Surface activation of the substrate to promote the adhesion of the metal
2. Electroless deposition of a thin layer of nickel metal
3. Electroplating of the titanium alloy coating to the substrate surface The substrate can be a variety of substrates; including, PC/ABS, ABS, Ultem and carbon foam. A plastic substrate which is called a specimen herein after is processed though the present invention. The surface activation of the specimen comprises an electrocleaning process, a first conditioning process, an etching process, a rinsing process, an activating process, a second conditioning process, an accelerating process, and a third conditioning process. As for the electrocleaning process, the chemical solution EC 71 by Miles chemical company is used as the electrocleaner solution to dehydrate the specimen which removes all of the surface water. The specimen is then moved to the first conditioning process and conditioned with counter flow rinses from a conditioner which is known as MacDermid 4MACuPlex NeutraPrep. The first conditioning process prepares the specimen for the next process which is the etching process. The best possible degree of adhesion and metallization is achieved by etching with 20% hydrochloric acid. The etching process is also responsible for the actual ability to metalize the specimen. Etching parameters directly influence surface chemistry. The mild etch enhances the formation of polar functional groups (—OH, —C═O, —COOH) on the plastic surface, where the percentage of hydroxyl groups (—OH) are found to be particularly high. These make a chemical link with a positively charged activator molecules whenever possible. In the rinsing process of the present invention, the specimen is processed through a plurality of rinses. A complex metal amine solution is used in the rinsing process. The specimen is then moved into the activating process of the present invention. The activation process is also known as palladium activation. The palladium activation is accomplished by an activator solution, McDermid Product-D-34C MACuPlex. The McDermid Product-D-34C MACuPlex is a highly concentrated and highly active liquid catalyst designed to activate plastics for subsequent immersion deposition of nickel. The palladium activation is followed by the second conditioning process which includes a plurality of rinses which is an alkaline solution. An accelerator solution of Enthone Product-887 is used in the accelerating process to further enhance catalytic activity. In the accelerating process, the specimen is prepared for the electroless deposition of nickel and the accelerating process also minimizes the catalyst drag-in. In the accelerator solution, the active metal is "wetted" to the plastic substrate via a bridge of sulfur as a result of a kind of vulcanization. These two reactions achieve an additional chemical adhesion. After the specimen is processed through the accelerating process, the third conditioning process is produced by a plurality of conditioning rinses.

As for the second step of the present invention, electroless deposition of the thin layer of nickel metal is coated on the specimen. The electroless nickel is used over the electrolytic nickel because; the electroless nickel provides a uniform coating of metal providing a uniform thickness, regardless of the shape of the specimen. The process allows a uniform deposition rate so the electroless nickel is evenly spread though the specimen. The electroless deposition of nickel is accomplished using alkaline McDermid Product called MID PHOS. During the process, pH value is maintained around 8.5-9.0 and the deposition rate is kept at 0.0001 μm/h. The desirable thickness of the nickel plating layer is between 1 μm-3 μm on the given specimen.

As for the third and final step, the actual process of electrolytic deposition of titanium alloy coating, also known as the electroplating of titanium alloy to the substrate surface, is performed. The process of the electroplating of titanium alloy comprises an anode, a cathode, an external current, and an electrolyte solution. The anode and the cathode are immersed in the electrolyte solution. The external current is connected to the anode and cathode. The applied voltage is from 1V to 4V and the external current comprises an anodic-current and a cathodic-current. The dissolution of the anode is made out of platinum and titanium alloy. The platinum in the anode acts as a catalyst to accelerate the oxidation process of the titanium. Deposition of metallic titanium alloys takes place in the cathode. When current flows the titanium ions are reduced to metallic titanium on the cathode made of activated plastic coated with nickel. The electroplating titanium is done by two different methods in the present invention and the two methods are listed below.

1. The application of direct current-continuous method.
2. The pulse plating method.

The Application of Direct Current-Continuous Method:

The direct current-continuous method involves continuous application of the external current at the same value and the external current is related to the rectifier output current. This process leads to a metal alloys crystalline deposition characterized by larger size of grain size on the specimen. In the direct current-continuous method, the size of the crystalline grain is of the order of 5000-50000 nm. The desired thickness of the titanium coating depends on the total time of electroplating. In the direct current-continuous method, the electrolyte solution is a concentrated sulfuric acid. Major source of the titanium is presented from the anode which dissolves in the sulfuric acid. An additional source of the titanium ions are obtained from potassium titanate which is dissolved in the sulfuric acid solution. The zirconium hydroxide present in the electrolyte solution is a source of zirconium. The titanium ions present in the electrolyte solution are in a form of Ti+2 (from anode dissolution) and Ti+4 (from titanate salt).

The Pulse Plating Method:

Conductivity between the anode and the cathode is provided by an acidic solution of titanium alloy salts. The present invention relies on development of the composition of the titanium alloy salt solutions to achieve 14-15% of different metal content in plated alloy. Suitable plating processes include tank, rack, barrel, and brush and drum plating. Following is list of the titanium alloy salt solutions composition which is used as the electrolyte in the present invention.

Example of the Electrolyte Composition:

1. $K_2TiO_3$—range (50 g-150 g)
2. $Na_2SO_4$—range (25 g-75 g)
3. $Zr(OH)_4$—range (20 g-60 g)
4. $Na_2CO_3$—to adjust pH=5-5.2 (range 4-6)
5. Sodium saccharin—range (0.5 g-1.5 g)

All of the above salt solutions are dissolved in 1 L of $H_2SO_4$ which have the concentration between 95-98%. The temperature of the titanium alloy salt solutions are kept around 176-190 F. The proper geometry of the titanium alloy salt solutions depends on the size of the specimen geometry. The present invention also relies on development of the concentration of sodium saccharin in the electrolyte. The pulse plating process described below leads to deposition of metal alloys in nanocrystalline form characterized by smaller grain size. Pulse plating current or DC plating current, from a DC power supply or pulse plating power supply is applied between the anode and the cathode. The pulse plating current density in the pulse plating method is situated to 120-150 Amps/SqF.

The pulse plating method, the electroplating technology is used to obtain crystal characterized by amorphous structure (nano-structure) of titanium alloy layer. The pulse plating current comprises an "ON" time and an "OFF" time. During the "ON" time, the titanium ions are plated out of the electrolyte solution near the cathode interface. The cathode diffusion layer begins to build, until the current is turned OFF. During the "OFF" time the electrolyte solution near the cathode interface becomes replenished with titanium ions. The diffusion layer is maintained to achieve evenly distributed thickness of deposited titanium. Such procedure yields improvements in the density across the cathode surface and guarantees more uniform deposit thickness. With pulse plating method, re-nucleation can occur with each pulse, greatly increasing the number of grains resulting in the grain reinforcement and nano structure buildup.

Deposition rates required are at least 20 um/h, preferably 60 um/h and more preferably greater than 80 um/h, by passing single or multiple D.C. cathodic-current pulses between the anode and the specimen. For an example, the cathode, at a cathodic-current pulse frequency in a range of approximately 0 to 900 Hz, at pulsed intervals during which the external current passes for the "ON" time period of at least 0.1 millisecond, typically in the range of about 0.1 to 50 millisecond and does not pass for the "OFF" time period in the range of about 0 to 500 millisecond. By passing single or multiple D.C. anodic-current pulses between the cathode and the anode at intervals during which the external current passes for the anodic-time period in the range of 0 to 50 millisecond, a cathodic duty cycle being in a range of 10% to 50%. Typically the "ON" time may be from 0.1-2.0 milliseconds long and the "OFF" time from 0.5 to 10.0 milliseconds long. The present invention is tested at the efficiency of pulse plating method with the following parameters: the "ON" time: between 0.2-2.0 milliseconds; the "OFF" time between 0.5-2.0 milliseconds and the duty cycle being between the 10%-50%. For an example, 40% duty cycle means the power is on 40% of the time and off 60% of the time. The present invention relies on producing the titanium or titanium alloys coatings obtained by pulse plating method with fine grain size. The sizes of the grains range from 6 nm to 10,000 nm on average, with preference for smaller grain sizes, which are less than 1000 nm. The desired thickness of the titanium coating depends on the total time of electroplating. The new method of electroplating of titanium alloy to plastic materials can be further optimized into following conditions under the application of direct current-continuous method and the pulse plating method.

Electroplating Conditions to be Optimized Further:

| | direct current-continuous method | pulse plating method |
|---|---|---|
| Deposition Temperature [F.] 176-190 | 176-190 | 180 |
| Duty Cycle [%] | 30-50 | 100 |
| Deposition Rate [μmlhr] | 40 | 8 |
| Average Coating Thickness: [μm] | 45-55 | 45-60 |
| Average Grain Size: [μm] | 0.025 | 10 |
| Yield Strength [Mpa] | 1000 | 700 |
| Hardness [VHN] | 600 | 340 |

The present invention can be applied to establish high strength coatings of titanium alloys. The resulting objects of the present invention are strong, wear resistant, light-weight and display high resilience that can be manufactured by a conventional and economical electroplating method. The present invention can be used on the articles which have strong and hard coatings, so the article can be further hardened by applying a suitable heat treatment after electroplating. The present invention can also be used in an automotive, aerospace, medical, defense and sport industries. The application of the pulse plating, fine grained, titanium alloys coating could be used for the production of strong, ductile, light-weight components requiring a high modulus of resilience, a high coefficient of restitution and a high tensional stiffness. The examples of applications include: helmets, bulletproof vests, shields for armor vehicles, any other shielding material built from small overlaid plates, highly efficient electrical batteries, automotive parts such as bumpers, door handles, engine pistons, other parts requiring exceptional hardness, dental implants, artificial limbs, artificial joints, sport and leisure equipment such as ski, snowboard equipment, construction parts of yachts (bows of yachts) and other equipments such as wheel chairs and hospital beds. It is an objective of the present invention to provide a metallic coating on the polymeric and other types of materials. Since the metallic coating is in a form of nano-titanium or nano-titanium alloy, the present invention is characterized by high yield strength, structural integrity, wear resistance and improved hardness, and excellent corrosion resistance. The unique combination of physical, mechanical and chemical properties makes the present invention an attractive technology for mentioned above industries. The present invention can be employed to create high strength, equiaxed coatings on metallic components, or non-conductive components that have been metalized to render them suitable for electroplating. In an alternative embodiment, the same process can be used to electroform a stand-alone article on a mandrel or other suitable substrate and, after reaching the desired plating thickness, to remove the free-standing electroformed article from the temporary substrate.

Figure 7:
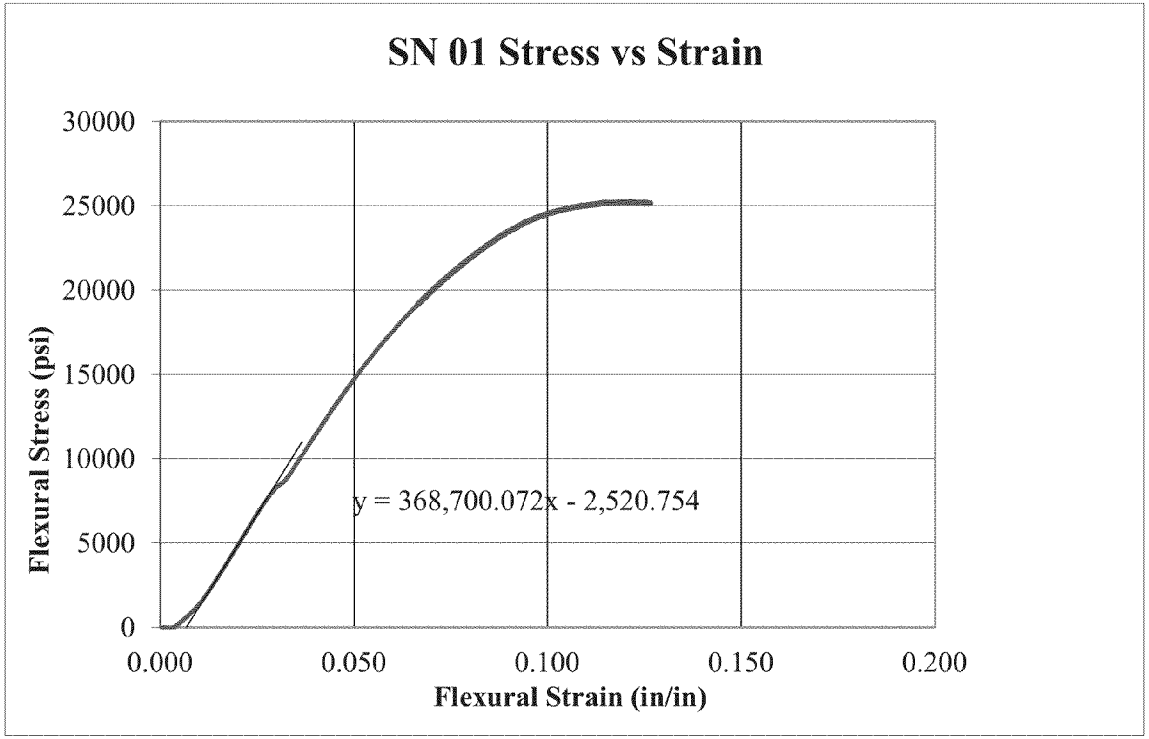
FIG. 7 is a flexural stress vs. flexural strain graph of test sample 01 which is a product of the present invention.
Figure 8:
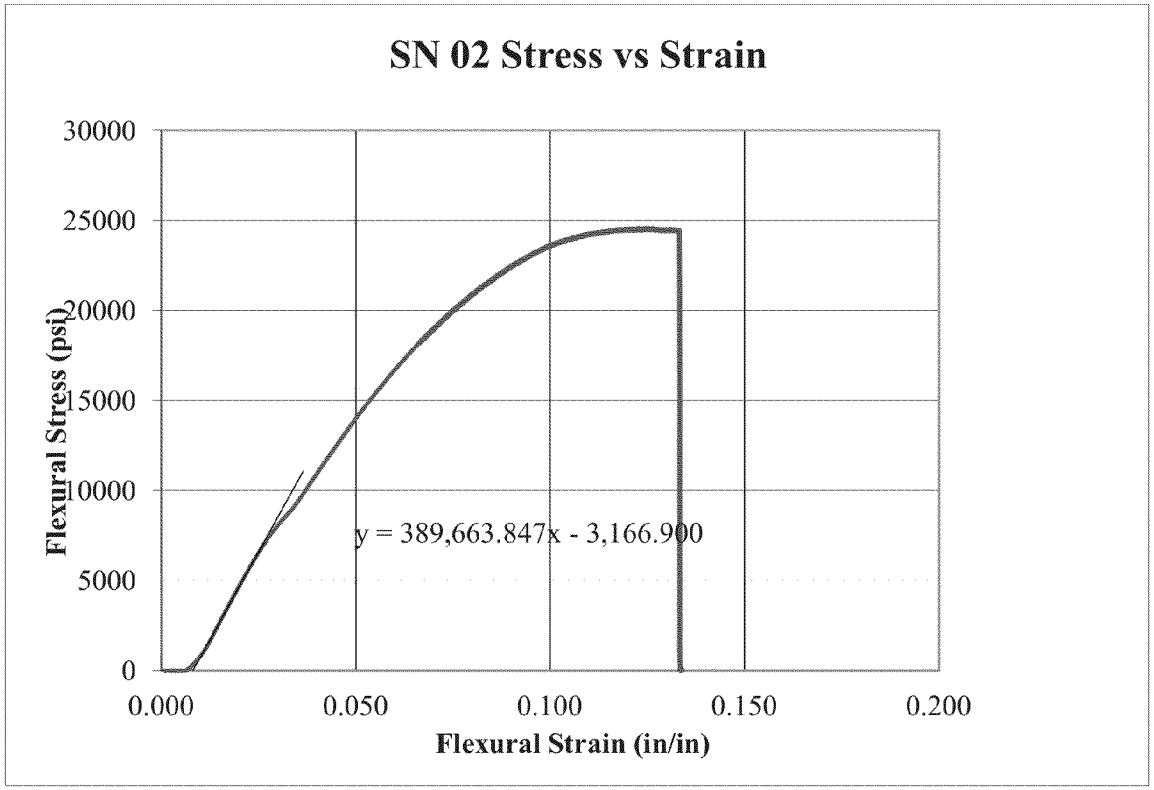
FIG. 8 is a flexural stress vs. flexural strain graph of test sample 02 which is a product of the present invention.
Figure 9:
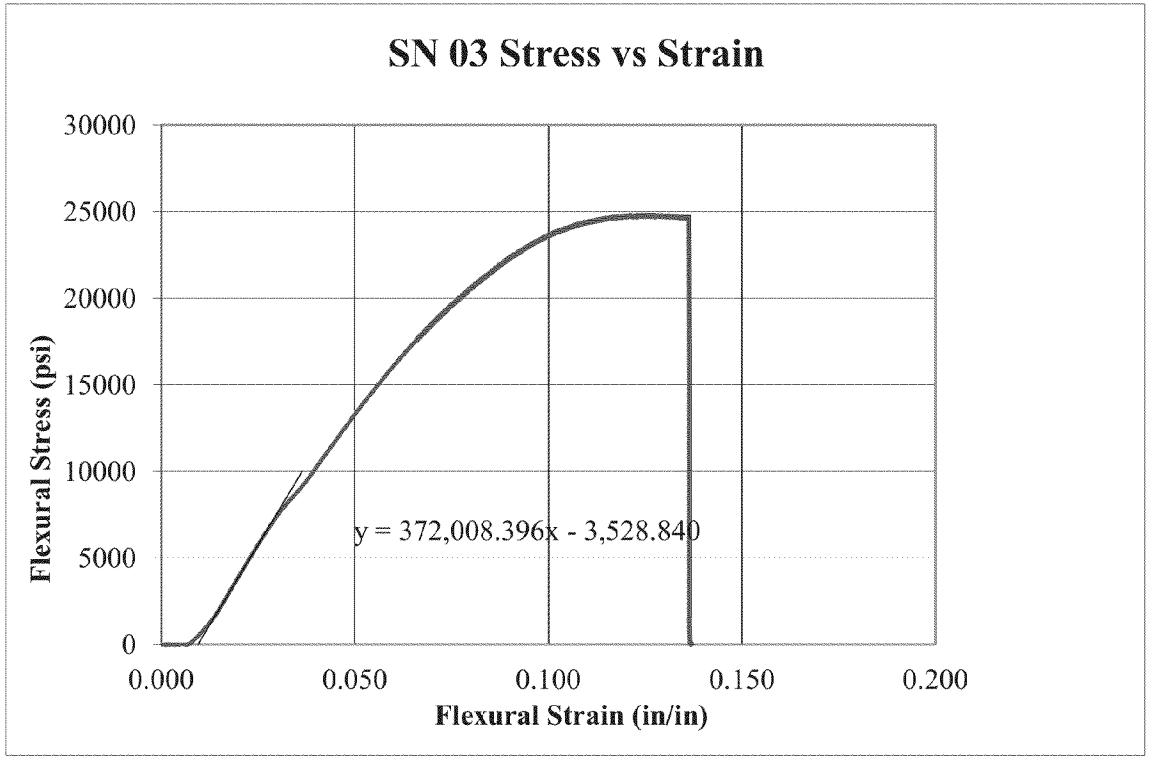
FIG. 9 is a flexural stress vs. flexural strain graph of test sample 03 which is a product of the present invention.
Figure 10:
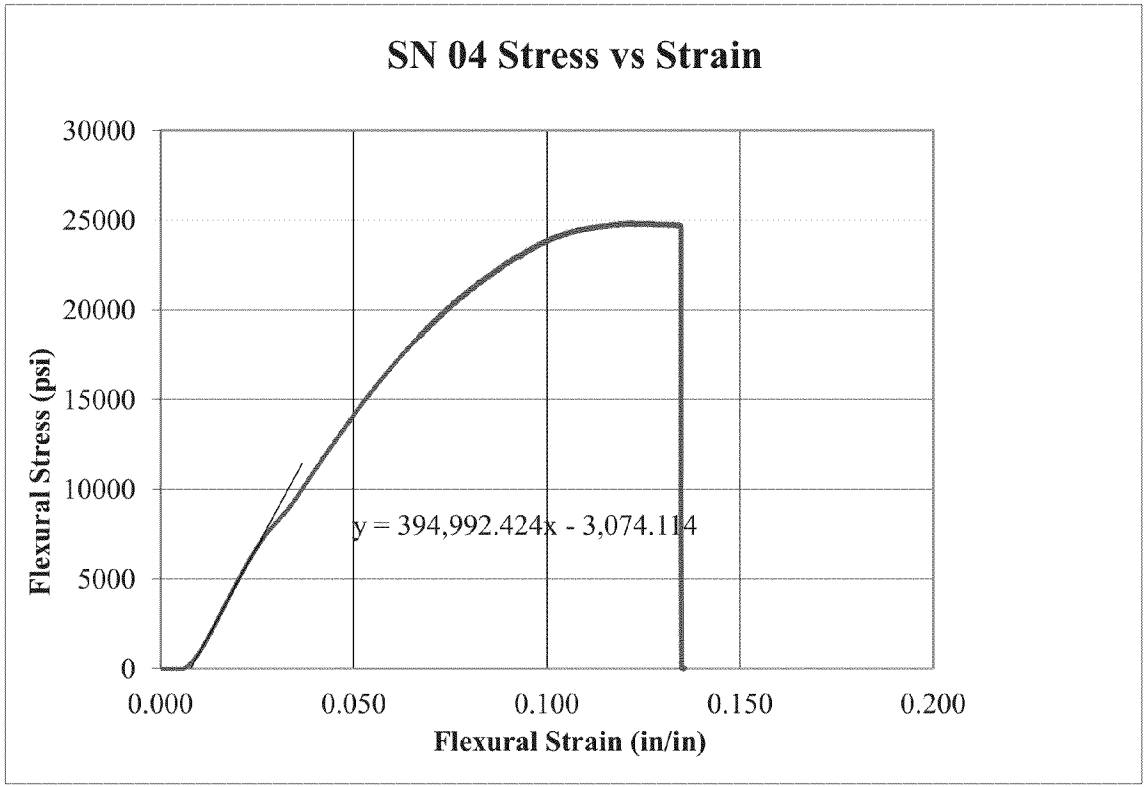
FIG. 10 is a flexural stress vs. flexural strain graph of test sample 04 which is a product of the present invention.
Figure 11:
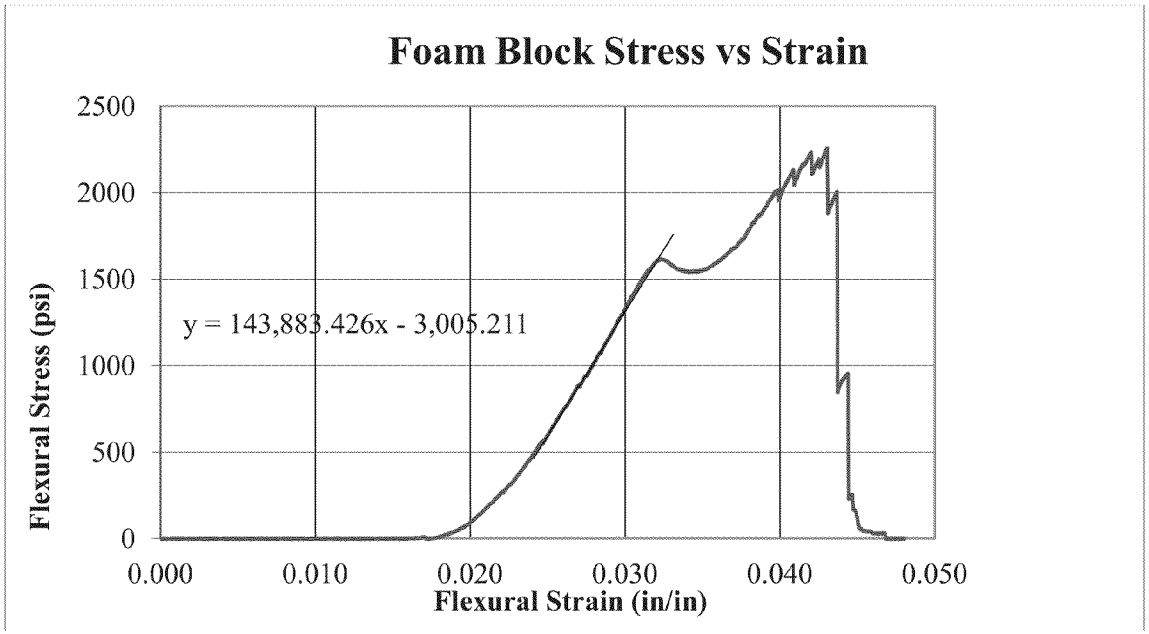
FIG. 11 is a flexural stress vs. flexural strain graph of test sample 05 (foam block) which is a product of the present invention.
Figure 15:
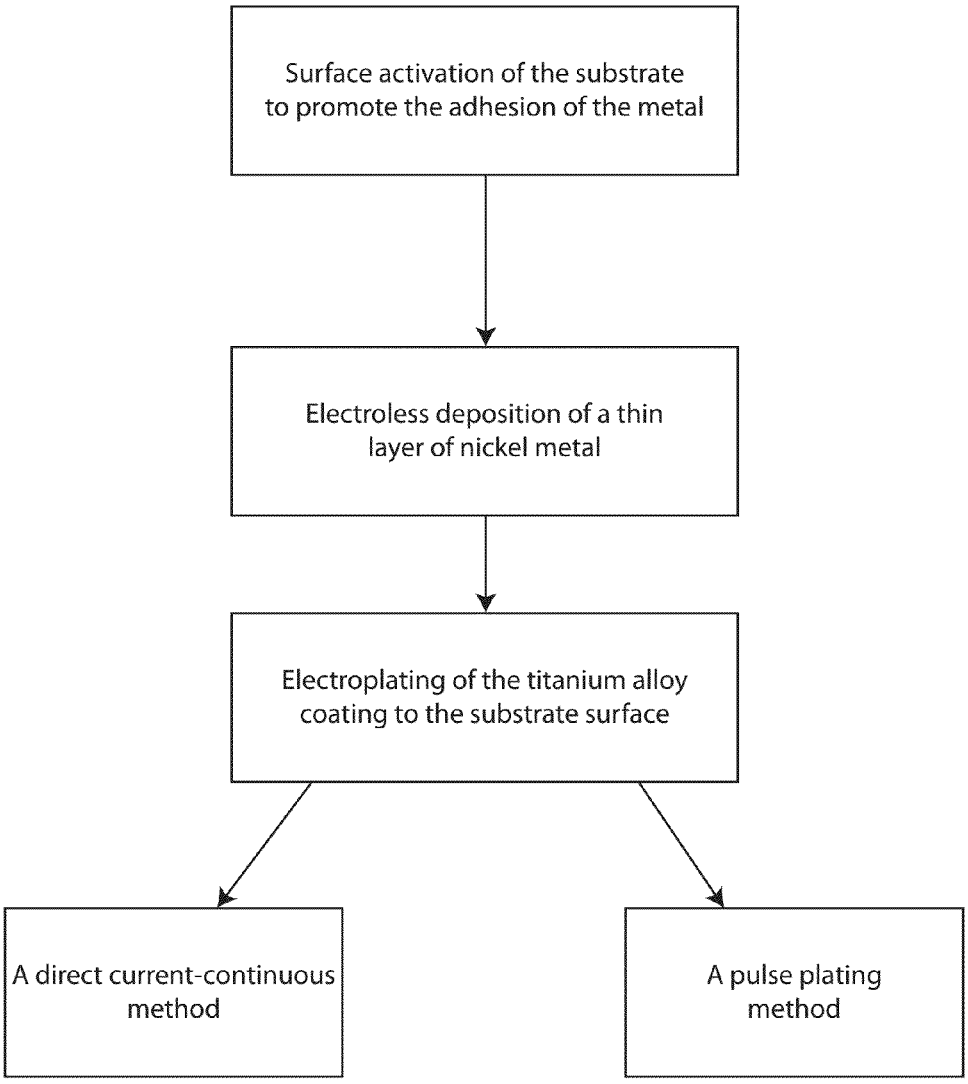
FIG. 15 is a system view of the present invention.
Figure 16:
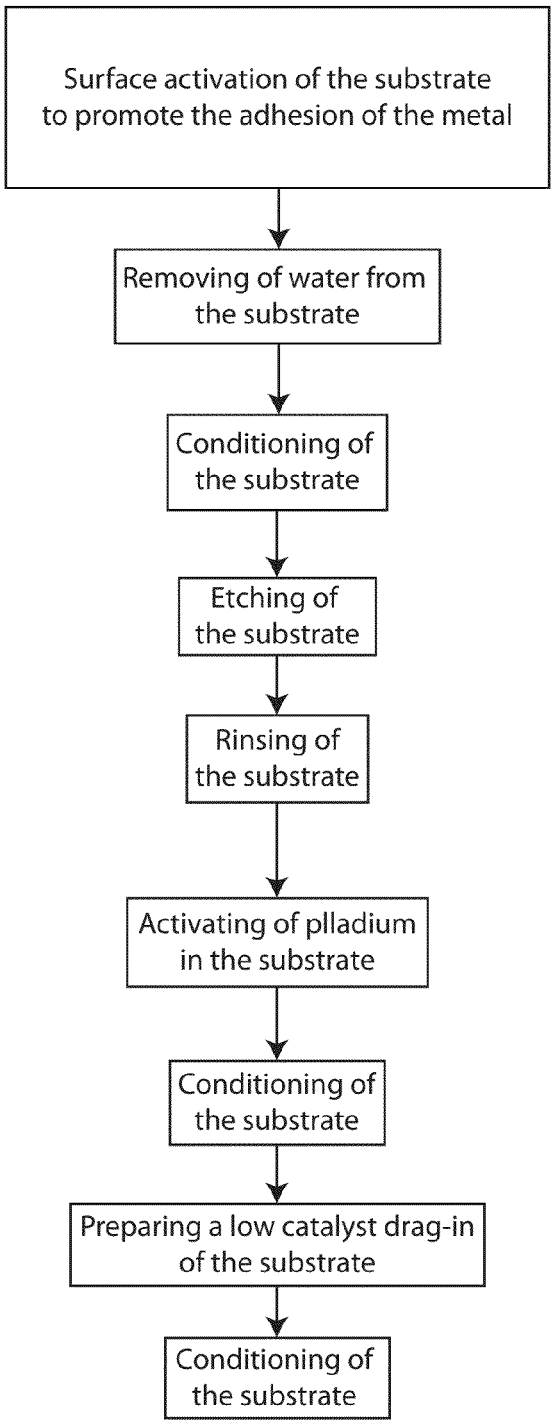
FIG. 16 is a detail system view of the surface activation of a substrate.
Figure 17:
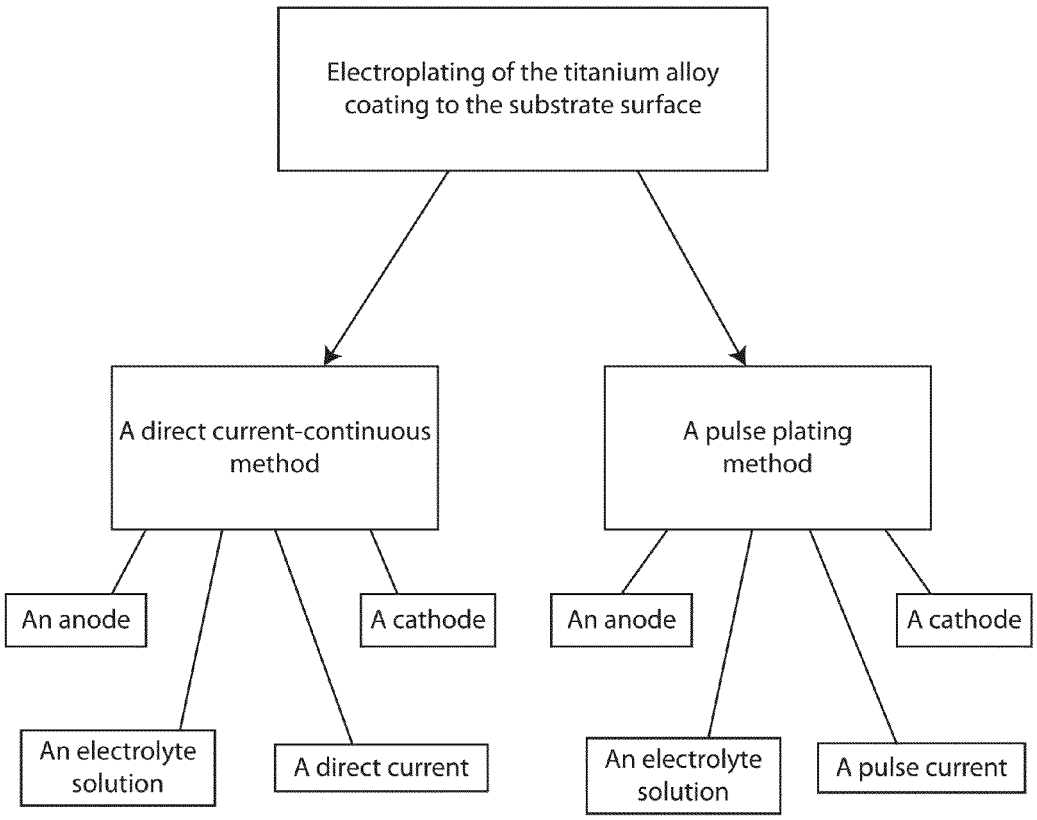
FIG. 17 is a detail system view of the direct current electroplating method and the pulse current electroplating method.
Figure 18:
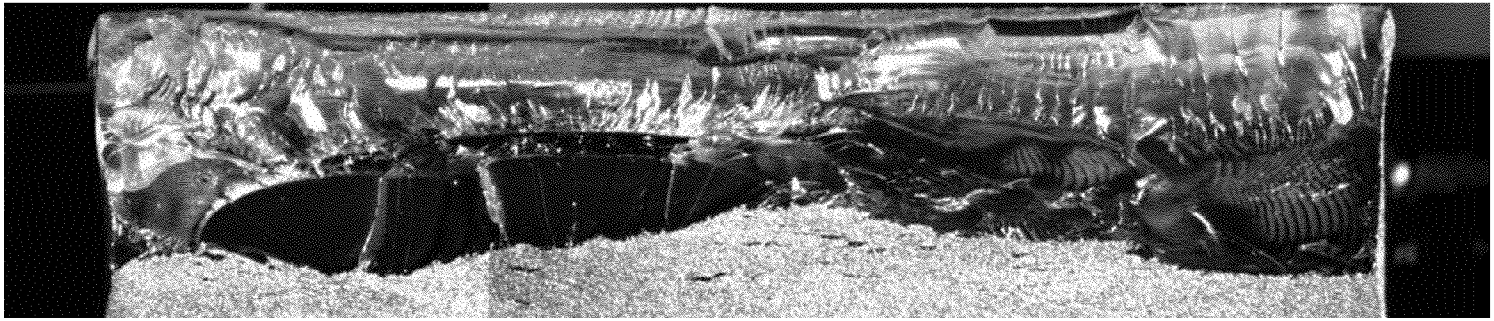
FIG. 18 is a failure cross section view from the test sample 03 under the microscope and the magnification being 16×.
Figure 19:
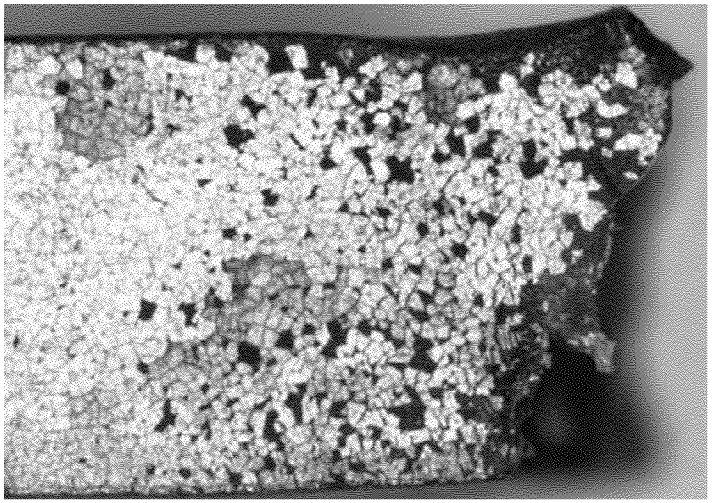
FIG. 19 is a side view of the failed section of the test sample 03 under the microscope and the magnification being 40×.
Figure 20:
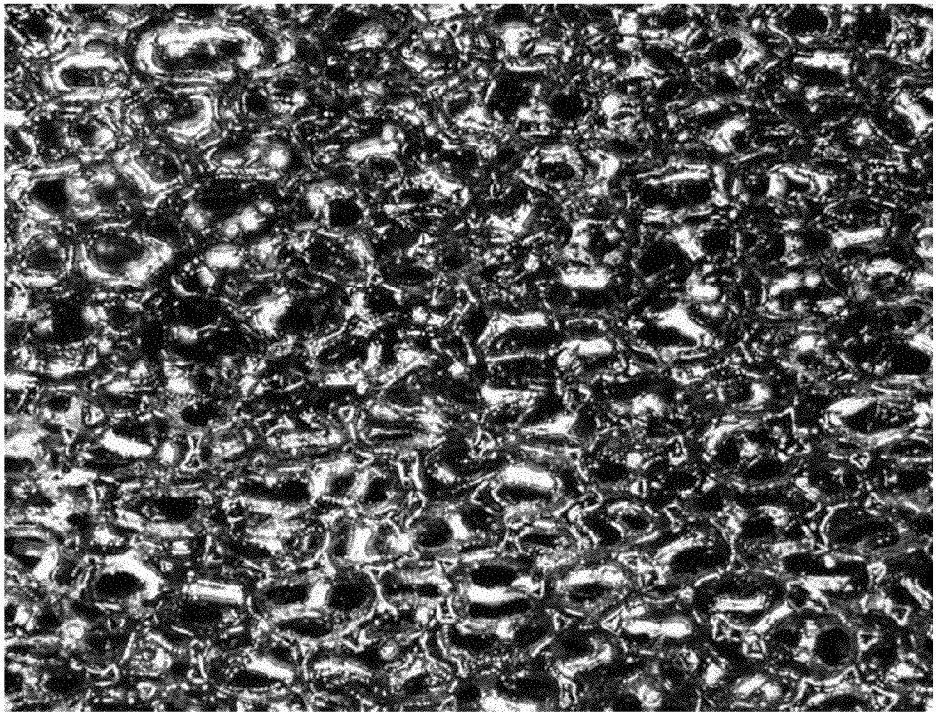
FIG. 20 is a view of the test sample 03 under the microscope and the magnification being 80×.
Figure 21:
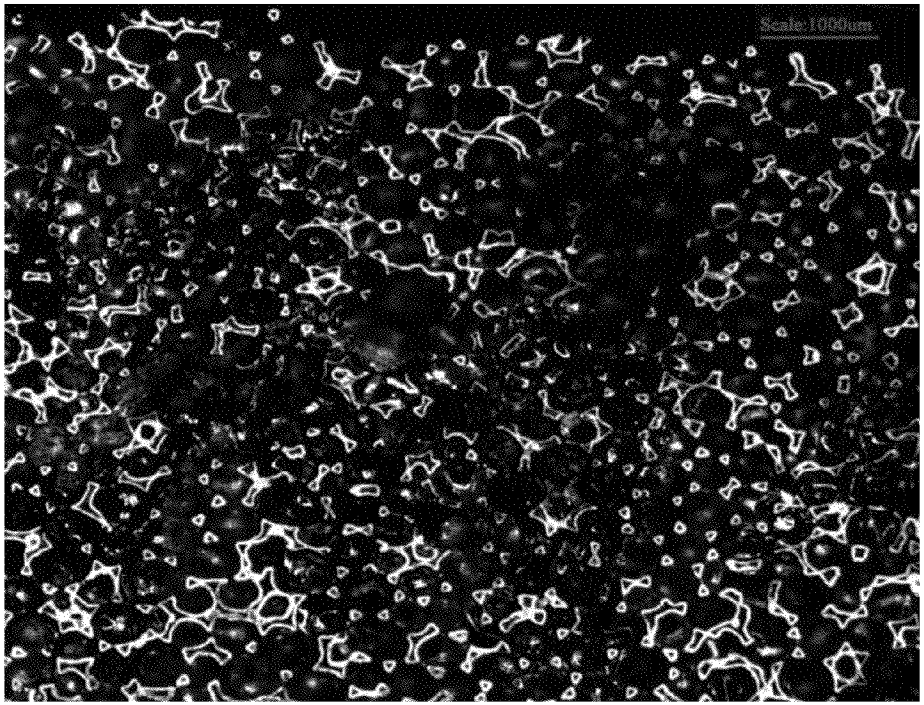
FIG. 21 is a polished cross section view of the test sample 03 under the microscope and the magnification being 18×.
Figure 22:
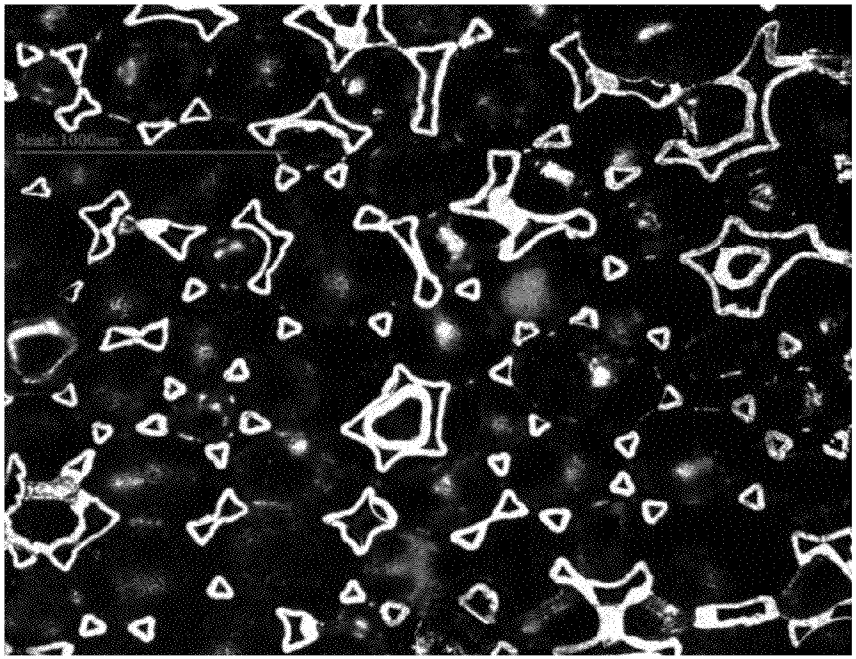
FIG. 22 is a polished cross section view of the test sample 03 under the microscope and the magnification being 41×
Figure 23:
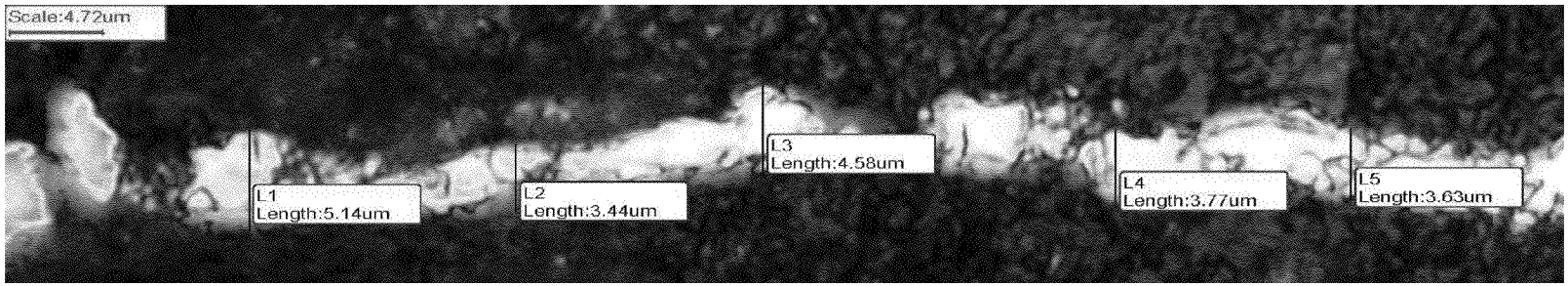
FIG. 23 is a view showing the titanium alloy coating thickness of the test sample 03 under the microscope and the magnification being 3100×.
Figure 24:
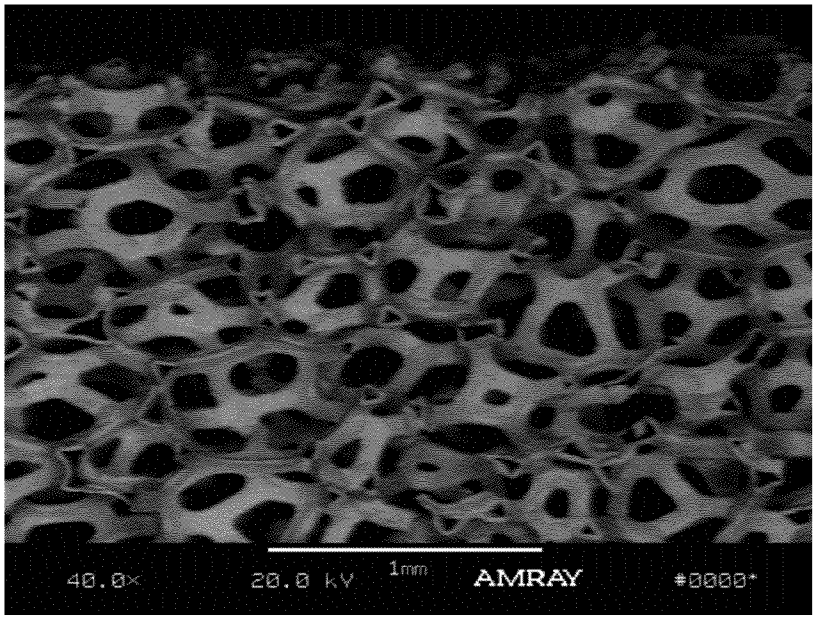
FIG. 24 is a fractured surface image of the test sample 03 under the electron microscopy and the magnification being 41×.
Figure 25:
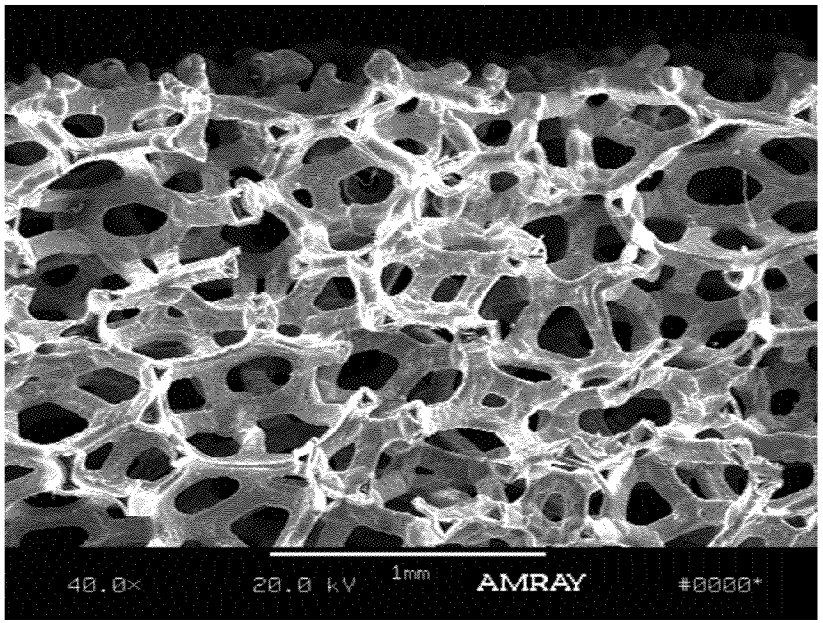
FIG. 25 is an image of elemental map cross section view of the test sample 03 under the electron microscopy and the magnification being 41×.
Figure 26:
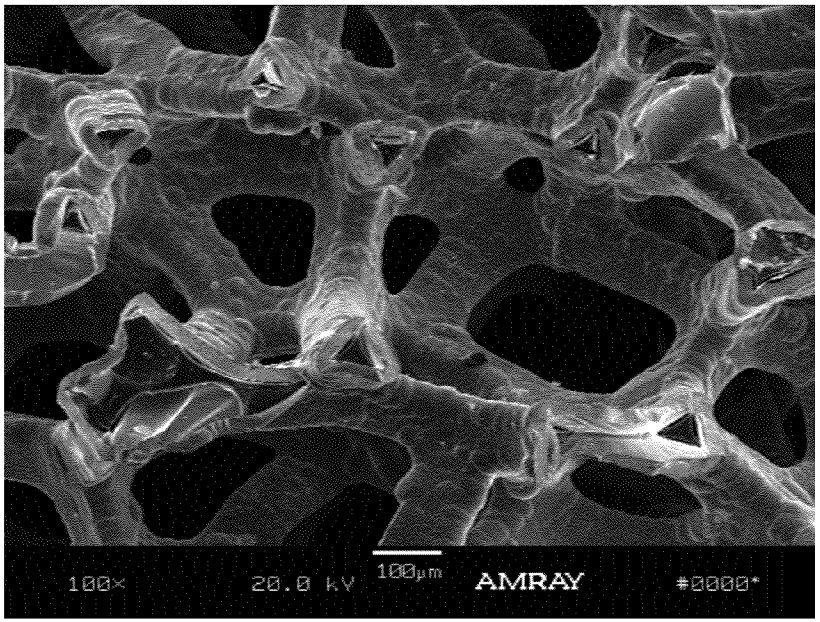
FIG. 26 is a cross section view of the test sample 03 under the electron microscopy and the magnification being 105×.
Figure 27:
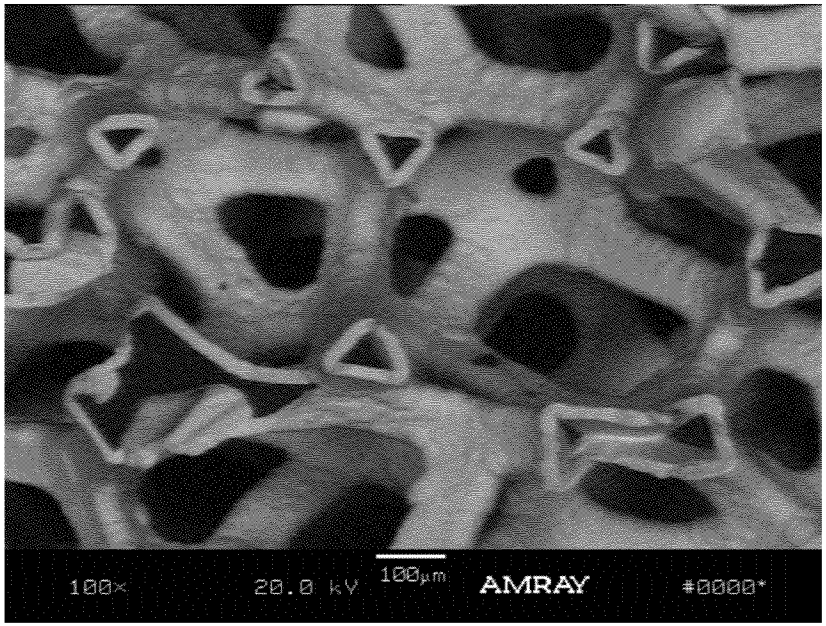
FIG. 27 is an image of elemental map cross section view of the test sample 03 under the electron microscopy and the magnification being 105×.
Figure 28:
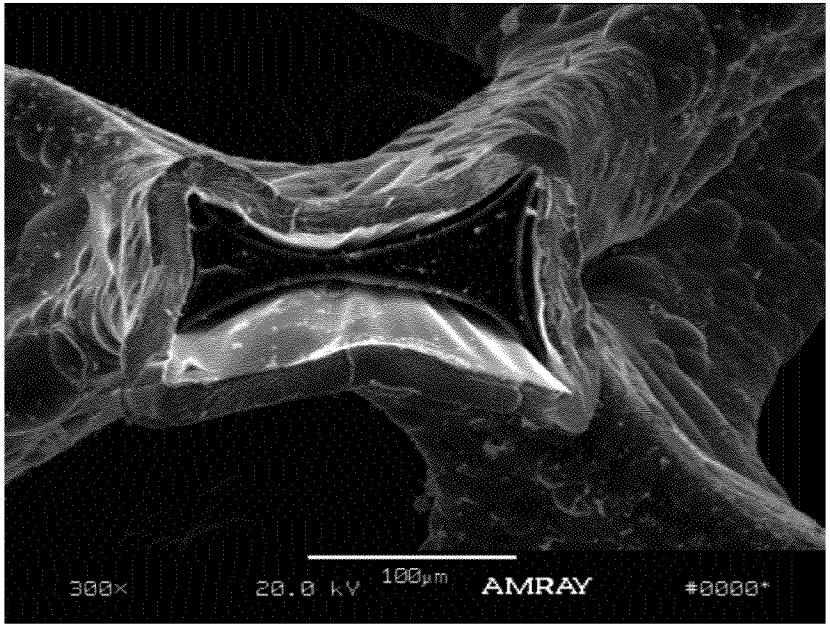
FIG. 28 is a cross section view of the test sample 03 under the electron microscopy and the magnification being 310×.
Figure 29:
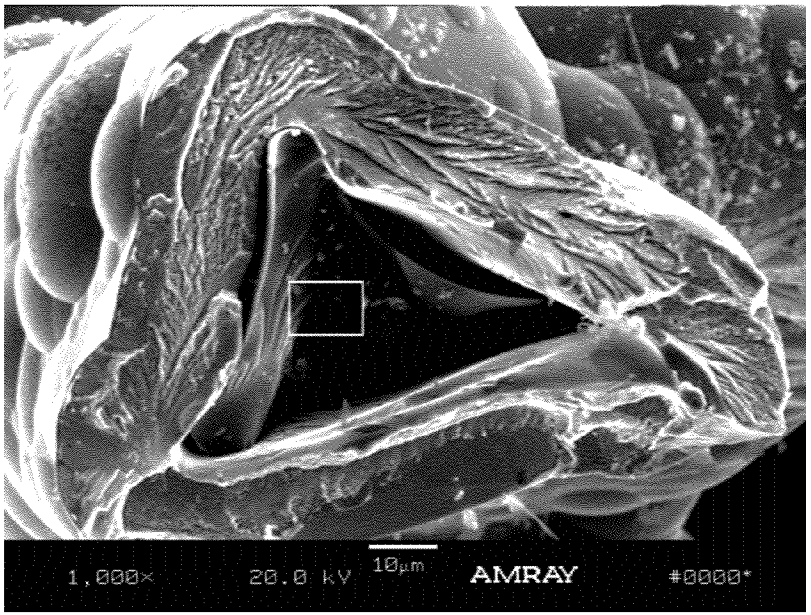
FIG. 29 is a cross section view of the test sample 03 under the electron microscopy and the magnification being 1050×.
Figure 30:
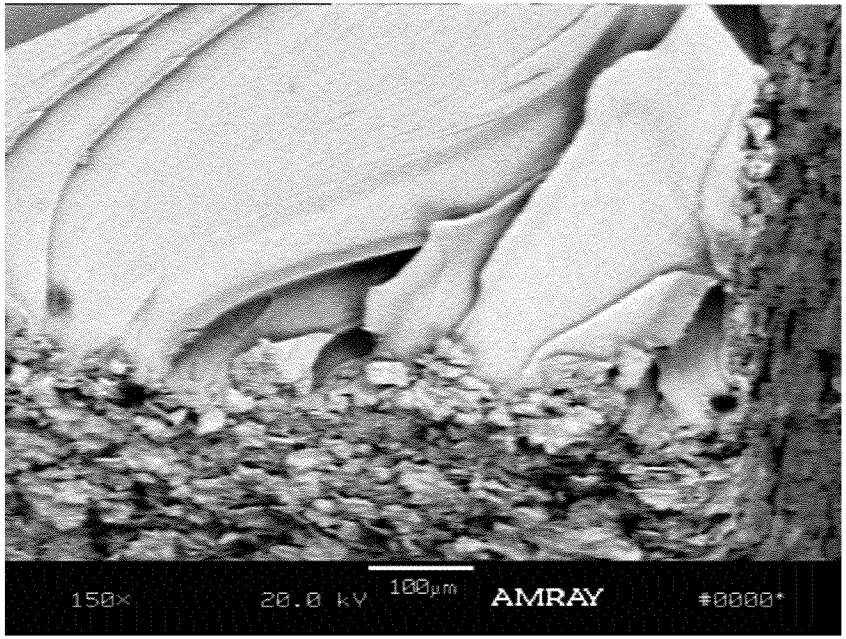
FIG. 30 is a view of edge failure in the test sample 01 under the electron microscopy and the magnification being 155×.
Figure 31:
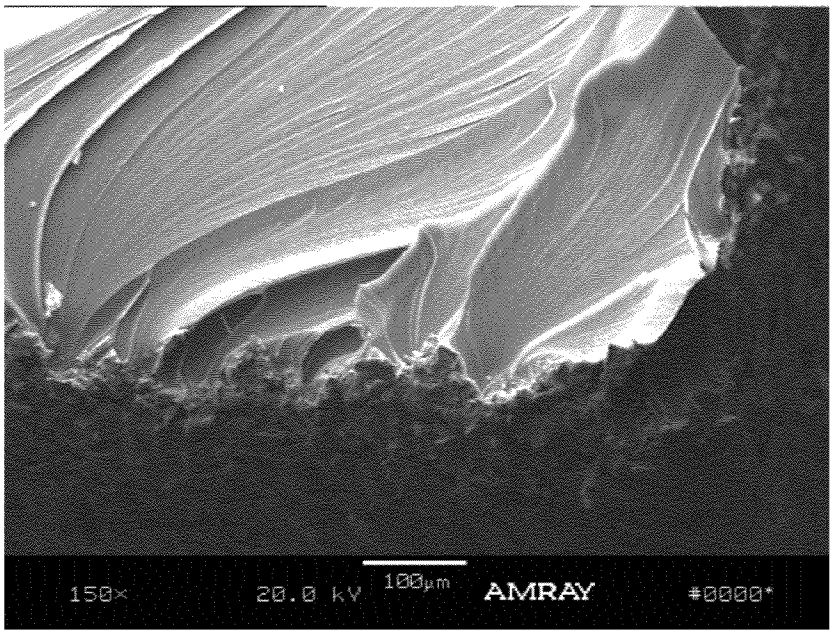
FIG. 31 is a view of edge failure in the test sample 01 under the electron microscopy and the magnification being 155×.
Figure 32:
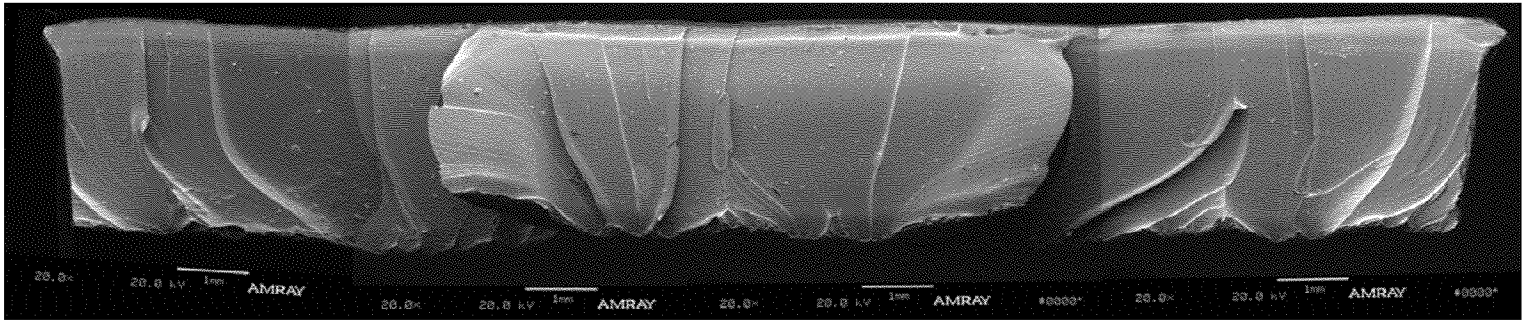
FIG. 32 is a cross section composite image of the test sample 01 under the electron microscopy and the magnification being 10×.

In reference to FIG. 7, FIG. 8, FIG. 9, FIG. 10, and FIG. 11 illustrates five different graphs. Each figure represents a single sample specimen of the present invention tested with reference to flexural stress vs. flexural strain. FIG. 12 demonstrates the completed results table from the four different samples. Normal flexural stress of plastic is around 8000 psi which is about 55 MPa. The flexural stress is around 25,000 psi for the plastics obtain from the present invention which is about 172 MPa. This is a good example of the new and improved plastic which obtains from the present invention. The unique physical, mechanical, and chemical properties of the present invention process are able to improve the ordinary plastic materials. The last row of the FIG. 12 explained about the test sample 05 which is experimented with the present invention. In reference to FIG. 13, a table shows the weighted percentage of the elements present in the first four tested samples. The second column in the described table illustrates the weight percentage of the elements present in the specimen cores and third column in the table illustrates the weight percentage of the elements present in the electroplated coats. In reference to FIG. 14, a table shows the weighted percentage of the elements present in the fifth tested sample. The second column in the described table illustrates the weight percentage of the elements present in the specimen core and third column in the table illustrates the weight percentage of the elements present in the electroplated coat.

Although the invention has been explained in relation to its preferred embodiment, it is to be understood that many other possible modifications and variations can be made without departing from the spirit and scope of the invention as hereinafter claimed.

What is claimed is:

1. A method for electroplating titanium and titanium alloys into a plastic or carbon foam comprises the steps in combination of:

(a) activating of a surface of a substrate to promotes adhesion of a metal, wherein the substrate is a plastic or carbon foam;

wherein the activating of the surface of the substrate further comprises the steps:

removing of water in the surface of the substrate by a dehydrator solution;

conditioning of the surface of substrate by a plurality of first counter flow conditioning rinses;

etching of the surface of the substrate is etched by a solution of 20% hydrochloric acid;

rinsing of the surface of the substrate is rinsed by a plurality of rinses;

activating of palladium in the surface of the substrate by an activator solution;

conditioning of the surface of the substrate is conditioned by a plurality of second conditioning rinses;

preparing a low catalyst drag-in of the surface of the substrate by an accelerator;

conditioning of the surface of the substrate is conditioned by a plurality of third conditioning rinses;

(b) depositing of electroless nickel metal to the surface of the substrate;

(c) electroplating of titanium and titanium alloys to the surface of the substrate; and depositing of electroless nickel metal onto the surface of the substrate wherein a pH level is maintained at 8.5-9 and a rate of deposition is kept at 0.0001 μm/h.

2. The method for electroplating titanium and titanium alloys into the plastic and carbon foam as claimed in claim 1 comprises, electroplating of titanium and titanium alloys to the surface of the substrate being selected from the group consisting of a direct current-continuous method and a pulse plating method.

3. The method for electroplating titanium and titanium alloys into the plastic and carbon foam as claimed in claim 2 comprises, depositing of larger sized grains on the surface of the substrate is accomplished by the direct current method wherein an external current being a direct current.

4. The method for electroplating titanium and titanium alloys into the plastic and carbon foam as claimed in claim 2 comprises, depositing of smaller sized grains on the surface of the substrate is accomplished by the pulse plating method wherein the external current being a pulse current.

5. The method for electroplating titanium and titanium alloys into the plastic and carbon foam as claimed in claim 4 comprises, wherein the pulse current further comprises the steps:

wherein a current density being 120-150 Amps/SqF;

wherein a pulse frequency being range from 0 to 900 Hz;

wherein a on time being 0.2-2.0 millisecond long;

wherein a off time being 0.5-2.0 millisecond long; and wherein a duty cycle being range from 10% to 50%.

6. A method for electroplating titanium and titanium alloys into a plastic or carbon foam comprises the steps in combination of:

(a) activating of a surface of a substrate to promotes adhesion of a metal, wherein the substrate is a plastic or carbon foam;

wherein the activating of the surface of the substrate further comprises the steps:

removing of water in the surface of the substrate by a dehydrator solution;

conditioning of the surface of substrate by a plurality of first counter flow conditioning rinses;

etching of the surface of the substrate is etched by a solution of 20% hydrochloric acid;

rinsing of the surface of the substrate is rinsed by a plurality of rinses;

activating of palladium in the surface of the substrate by an activator solution;

conditioning of the surface of the substrate is conditioned by a plurality of second conditioning rinses;

preparing a low catalyst drag-in of the surface of the substrate by an accelerator;

conditioning of the surface of the substrate is conditioned by a plurality of third conditioning rinses;

(b) depositing of electroless nickel metal to the surface of the substrate; and (c) electroplating of titanium and titanium alloys to the surface of the substrate.

7. The method for electroplating titanium and titanium alloys into the plastic and carbon foam as claimed in claim 6 comprises, depositing of electroless nickel metal onto the surface of the substrate wherein a pH level is maintained at 8.5-9 and a rate of deposition is kept at 0.0001 μm/h.

8. The method for electroplating titanium and titanium alloys into the plastic and carbon foam as claimed in claim 7 comprises, electroplating of titanium and titanium alloys to the surface of the substrate being selected from the group consisting of a direct current-continuous method and a pulse plating method.

9. The method for electroplating titanium and titanium alloys into the plastic and carbon foam as claimed in claim 8 comprises, depositing of larger sized grains on the surface of the substrate is accomplished by the direct current method wherein an external current being a direct current.

10. The method for electroplating titanium and titanium alloys into the plastic and carbon foam as claimed in claim 8 comprises, depositing of smaller sized grains on the surface of the substrate is accomplished by the pulse plating method wherein the external current being a pulse current.

11. The method for electroplating titanium and titanium alloys into the plastic and carbon foam as claimed in claim 10 comprises, wherein the pulse current further comprises the steps:
wherein a current density being 120-150 Amps/SqF;
wherein a pulse frequency being range from 0 to 900 Hz;
wherein a ON time being 0.2-2.0 millisecond long;
wherein a OFF time being 0.5-2.0 millisecond long; and
wherein a duty cycle being range from 10% to 50%.

12. A method for electroplating titanium and titanium alloys into a plastic or carbon foam comprises the steps in combination of:

(a) activating of a surface of a substrate to promotes adhesion of a metal, wherein the substrate is a plastic or carbon foam;

wherein the activating of the surface of the substrate further comprises the steps:

removing of water in the surface of the substrate by a dehydrator solution;

conditioning of the surface of substrate by a plurality of first counter flow conditioning rinses;

etching of the surface of the substrate is etched by a solution of 20% hydrochloric acid;

rinsing of the surface of the substrate is rinsed by a plurality of rinses;

activating of palladium in the surface of the substrate by an activator solution;

conditioning of the surface of the substrate is conditioned by a plurality of second conditioning rinses;

preparing a low catalyst drag-in of the surface of the substrate by an accelerator;

conditioning of the surface of the substrate is conditioned by a plurality of third conditioning rinses;

(b) depositing of electroless nickel metal to the surface of the substrate wherein a pH level is maintained at 8.5-9 and a rate of deposition is kept at 0.0001 μm/h; and (c) electroplating of titanium and titanium alloys to the surface of the substrate.

13. The method for electroplating titanium and titanium alloys into the plastic and carbon foam as claimed in claim 12 comprises, electroplating of titanium and titanium alloys to the surface of the substrate being selected from the group consisting of a direct current-continuous method and a pulse plating method.

14. The method for electroplating titanium and titanium alloys into the plastic and carbon foam as claimed in claim 13 comprises, depositing of larger sized grains on the surface of the substrate is accomplished by the direct current method wherein an external current being a direct current.

15. The method for electroplating titanium and titanium alloys into the plastic and carbon foam as claimed in claim 13 comprises, depositing of smaller sized grains on the surface of the substrate is accomplished by the pulse plating method wherein the external current being a pulse current.

16. The method for electroplating titanium and titanium alloys into the plastic and carbon foam as claimed in claim 15 comprises, wherein the pulse current further comprises the steps:
wherein a current density being 120-150 Amps/SqF;
wherein a pulse frequency being range from 0 to 900 Hz;
wherein a on time being 0.2-2.0 millisecond long;
wherein a off time being 0.5-2.0 millisecond long; and
wherein a duty cycle being range from 10% to 50%.

* * * * *